US007699182B2

(12) United States Patent
Yourist

(10) Patent No.: US 7,699,182 B2
(45) **Date of Patent: *Apr. 20, 2010**

(54) CONTAINER HAVING BROAD SHOULDER AND NARROW WAIST

(75) Inventor: Sheldon Yourist, York, PA (US)

(73) Assignee: Graham Packaging Company, L.P., York, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/237,597

(22) Filed: Sep. 25, 2008

(65) Prior Publication Data

US 2009/0020498 A1 Jan. 22, 2009

Related U.S. Application Data

(63) Continuation of application No. 11/015,644, filed on Dec. 20, 2004, now Pat. No. 7,438,196.

(51) Int. Cl.
*B65D 1/02* (2006.01)
*B65D 1/40* (2006.01)
*B65B 7/20* (2006.01)

(52) U.S. Cl. ..... 215/381; 215/284; 220/669; 220/675; 53/471

(58) Field of Classification Search ..... 215/373, 215/381–384, 379; 220/606, 608, 609, 666, 220/669, 672, 675; 53/471
See application file for complete search history.

(56) References Cited

U.S. PATENT DOCUMENTS 3,536,500 A 10/1970 Cleereman et al.
3,708,082 A 1/1973 Platte
4,298,045 A 11/1981 Weiler et al.
4,372,455 A 2/1983 Cochran
4,497,855 A 2/1985 Agrawal et al.
4,615,928 A 10/1986 Kawaguchi et al.
4,749,092 A 6/1988 Sugiura et al.
4,877,141 A 10/1989 Hayashi et al.
5,037,684 A 8/1991 Dundas et al.
5,117,993 A 6/1992 Vesborg
5,141,120 A 8/1992 Brown et al.
5,141,121 A 8/1992 Brown et al.
5,222,615 A 6/1993 Ota et al.
D344,457 S 2/1994 Prevot et al.

(Continued)

FOREIGN PATENT DOCUMENTS

WO 00/50309 A1 8/2000

*Primary Examiner*—Sue A Weaver
(74) *Attorney, Agent, or Firm*—Knoble Yoshida & Dunleavy, LLC

(57) ABSTRACT

The invention relates to a plastic container having a neck, shoulder, base and body portion. There are longitudinal base panel portions with rounded, longitudinal base panel edges separating each of said flattened portions from each other at a waist. The waist has a circumferential dimension less than the base and is positioned between the body portion and the base. The body portion is positioned between the waist and the circular shoulder and has flexible, substantially flat longitudinal body panels and rounded, longitudinal body panel edges separating adjacent body panels from each other and merging with the longitudinal panel edges of said base. The longitudinal body edges increase in width as the body longitudinally merges with the circular shoulder portion, and the circular shoulder portion has a rounded portion transitioning into and merging with the body panels, and a sloping portion of reducing diameter merging with the neck.

15 Claims, 7 Drawing Sheets

U.S. PATENT DOCUMENTS

| | | | | |
|---|---|---|---|---|
| 5,350,078 | A | 9/1994 | Potts et al. | |
| 5,381,910 | A | 1/1995 | Sugiura et al. | |
| 5,392,937 | A | 2/1995 | Prevot et al. | |
| 6,913,405 | B2 | 7/2005 | Fischer et al. | |
| 7,438,196 | B2 * | 10/2008 | Yourist | 215/381 |
| 2001/0035392 | A1 | 11/2001 | Ota et al. | |
| 2002/0000421 | A1 | 1/2002 | Ota et al. | |
| 2004/0159627 | A1 | 8/2004 | Trude | |
| 2005/0045645 | A1 | 3/2005 | Tsutsui et al. | |
| 2006/0108317 | A1 | 5/2006 | Tanaka et al. | |

* cited by examiner

CONTAINER HAVING BROAD SHOULDER AND NARROW WAIST

This Application is a Continuation of U.S. patent application Ser. No. 11/015,644, now U.S. Pat. No. 7,438,196 filed on Dec. 20, 2004, the contents of which are herein incorporated by reference.

BACKGROUND OF THE INVENTION

1. Field of the Invention

The present invention relates generally to a hollow blow-molded container, and more particularly to a uniquely shaped blow-molded container able to accommodate a hot-fill and sealing process without any apparent adverse effects on the container's tactile feel or visual appearance.

2. Description of Related Art

Lightweight containers made of thermoplastic materials such as polyester, polyamide, and polyolefin resin and other thermoplastic polymers are well known in the container industry. Polyester containers produced by the conventional molding process, however, exhibit extremely high thermal distortion which makes them unsuitable for the packaging of products which require filling at elevated temperatures.

In most packaging facilities the techniques and apparatus presently employed require that a filled container be capped and sealed immediately after the filling operation (while the contents are still hot). The contents in the sealed container and the warmed head space shrink as they cool, resulting in a partial vacuum being created inside the container. Resulting pressure differentials create a net pressure force on the outside of the container walls which can cause the container to buckle or collapse. This uncontrolled buckling is aesthetically unattractive and renders the containers commercially unacceptable. While containers can be stiffened, e.g., with integrally molded ribs and the like or by increasing the wall thickness, these techniques are not always practical to produce a container which can resist the vacuum-induced buckling forces generated in hot-fill applications. Small containers, which have less surface area for structural reinforcement, present a particular problem. It can be difficult to design a small container that is aesthetically pleasing and structurally sound.

Deformation upon the hot-filling and sealing in a container results from two distinct phenomena. The first is a thermal phenomenon. When the hot contents contact the polyester container, the container walls shrink, usually unevenly, causing distortion of the container. Thermal stabilization alone, however, is not sufficient to render a plastic bottle suitable for most commercial hot-fill applications, in which capping is effected immediately after filling to facilitate high speed processing.

The second deforming phenomenon present in hot-fill applications occurs when a thermoplastic container is filled with a hot liquid (such as a liquid sterilized at a high temperature) and sealed. Subsequent thermal contraction of the liquid upon cooling results in partial evacuation of the container which tends to deform the container walls. Backflow into a filling mechanism and the use of vacuum filling equipment during filling operations can similarly create a partial vacuum inside the container resulting in its deformation. Such deformation typically concentrates at the mechanically weaker portions of the container, resulting in an irregular and commercially unacceptable appearance. Further, if the deformation occurs in an area where the label is attached to the container, the appearance of the label may be adversely affected as a result of container deformation.

In order to avoid collapse from these internal vacuum forces it is necessary to either produce a container which is sufficiently rigid to withstand forces of this magnitude or to provide for a reduction in the container volume to offset the volume change during cooling. Practical limitations in the manufacture of plastic containers, however, prevent the production of commercially acceptable containers of sufficient rigidity to withstand these pressure forces.

By increasing the wall thickness of the container it is possible to some extent to strengthen the container walls and thus decrease the effects of vacuum deformation. However, increasing the wall thickness results in a substantial increase in the amount of raw materials required to produce the container and a substantial decrease in production speed. The resultant increased costs are not acceptable to the container industry. Additionally, increase in wall thickness results in decrease in bottle fill capacity.

A prior attempt to reduce the effects of vacuum deformation is disclosed in U.S. Pat. No. 3,708,082 to Platte. Platte discloses a plastic container with four flat wall-panels comprising the body portion of the container. A rib circumscribes the entire container in a region below the handle and serves to rigidify the side wall-portions in a circumferential direction. The rib also acts as a hinge to allow limited inward collapsing of the container along selected regions.

Another prior approach to reduction of the effects of vacuum deformation is to provide a container with a plurality of recessed collapse panels, separated by lands, which allow uniform controlled inward deformation so that vacuum effects are accommodated in a uniform manner without adverse effects on the appearance of the container. A container having such vacuum flex panels is disclosed in International Publication No. WO 00/50309 (Melrose), which is incorporated herein by reference. The container has a controlled deflection vacuum flex panel that inverts and flexes under pressure to avoid deformation and permanent buckling of the container. It includes an initiator portion, which has a lesser projection than the remainder of the flex panel and initiates deflection of the flex panel.

U.S. Pat. No. 4,877,141 to Hayashi et al. discloses a pressure resistant bottle shaped container having panels with stress absorbing strips. The panels prevent permanent deformation that result from pressure changes when the container is filled with high temperature liquids. U.S. Pat. Nos. 5,141,120 and 5,141,121 to Brown et al. both of which are hereby incorporated by reference, disclose a hot fill container having opposing pinch grip indentations in the sidewall. The indentations collapse inwardly toward each other to accommodate internal forces that result from filling the container with high temperature liquid. Another example of containers having such vacuum flex panels is disclosed in U.S. Pat. No. 5,392,937 and Des. 344,457 to Prevot et al., both of which are assigned to the assignee of the present invention and are hereby incorporated by reference. In these containers, a grip structure moves with the vacuum flex panel in response to the vacuum created inside the container in response to hot-filling, capping, and cooling of container contents.

U.S. Pat. No. 4,732,455 to Cochran discloses a lightweight thermoplastic container having four flat sidewalls connected by curved corner portions and a bottom portion connected to the flat sidewalls by curved base portions. The container also has longitudinally extending ribbing structures in opposing corner portions to withstand hydrostatic forces without buckling or dimpling.

Agrawal et al., U.S. Pat. No. 4,497,855 discloses a container with a plurality of recessed collapse panels, separated by land areas, which allows uniformly inward deformation under vacuum force. The vacuum effects are controlled without adversely affecting the appearance of the container. The panels are drawn inwardly to vent the internal vacuum and so prevent excess force being applied to the container structure, which would otherwise deform the inflexible post or land area structures. The amount of "flex" available in each panel is limited, however, and as the limit is approached there is an increased amount of force that is transferred to the side walls.

U.S. Pat. No. 4,298,045 to Weiler et al. shows another prior art approach in which a thermoplastic container has rigidifying grooves and embossments provided in the side walls of the container. Rather than controlling collapse, these rigidifying features substantially eliminate collapse, and are thus useful only with relatively low levels of evacuation.

Prior art approaches, including the use of flex or collapse panels to overcome thermal deformation are not without problems. While collapse panels accommodate a great degree of controlled deformation, as the vacuum inside the containers increases, more and more collapse is required from the collapse panels without permitting collapse of the intervening lands. By increasing the length of the corner step of the collapse panels the rigidity of the lands may be increased. However, the resultant deeper collapse panel occupies a larger internal volume of the container, and the overflow capacity of the container is significantly decreased. In order to compensate for this decrease in overflow capacity, the container diameter must be increased. Any increase in container diameter, however, decreases container rigidity. Thus, any container rigidity gained by increase in the size of the collapse panel is offset by the need to regain the lost overflow capacity. The present invention eliminates the aforementioned disadvantages.

BRIEF SUMMARY OF THE INVENTION

The present invention is directed to a container and the method of making the container having a longitudinal axis therethrough and including a neck portion having a longitudinal height and terminating at an opening. A circular enclosed base is located opposite the neck and adapted for maintaining the container in an upright position. The base has a rounded, positive slope portion having an increasing circumferential dimension transitioning into a decreasing circumferential dimension portion having a negative slope along the longitudinal axis. The container further transitions from a circular rounded portion at the base to generally flattened, longitudinal base panels with rounded, longitudinal base panel edges separating each of the flattened base panels from each other. The container further includes a waist having a circumferential dimension less than that of the base and positioned between a body portion and the base. The body portion is positioned between the waist and a circular shoulder and includes flexible, flat longitudinal body panels and rounded, longitudinal body panel edges separating adjacent body panels from each other and merging with the edges of the base. The longitudinal body panel edges increase in width as the body longitudinally merges with a shoulder portion. A circular shoulder portion having a rounded position merging with the body and a sloping portion of reducing diameter merging with the neck is also present.

In one embodiment of the present invention, the container can accommodate a hot-fill production process. In a further embodiment, the container can withstand an internal vacuum when sealed with a closure component. The longitudinal body panel edges of the container can be made of more plastic than the flexible body panel portions. The container is suitable for holding fruit drinks, dairy-based drinks, and the like.

The container can be manufactured by blow molding from, for example, a polyolefin. In some embodiments, the circumferential dimension of the container shoulder at its widest point is no greater than the greatest circumferential dimension of the base. The longitudinal length of the body of the container can be greater than the longitudinal length of the base; for example, the length of the body can be about 2.3 times the length of the base.

The invention is also directed to a method of blow molding the container described above. The invention is further directed to a method of accommodating an internal vacuum in a container including forming a container having the features described above, wherein the longitudinal body panels are adapted to flex inwardly in response to an internal vacuum. In one embodiment, the waist of the container is adapted to isolate flexure of the body panels from the flexure of the flattened portion of the base.

This invention provides a container that is suitable for hot-fill applications without the problems present in prior art solutions. The container collapses evenly during filling, maintaining its overall shape, overcoming the challenges of the prior art.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Figure 1:
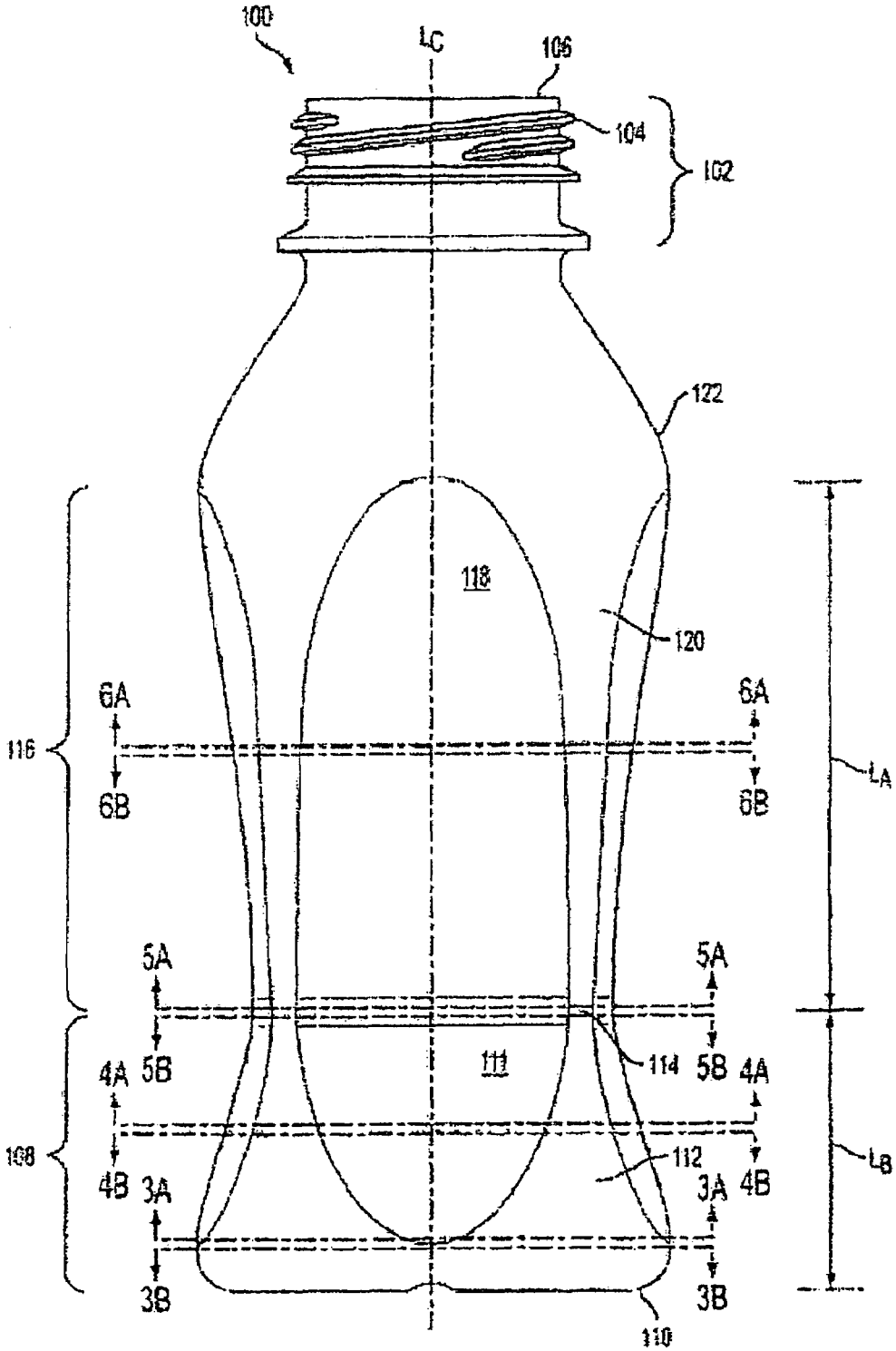
FIG. 1 depicts a front view of the container according to the present invention.

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention. All references cited herein are incorporated by reference as if each had been individually incorporated.

The present invention is a container 100 having a longitudinal axis, $L_C$. In the embodiment illustrated in FIG. 1, the container 100 has a neck 102 and can have a closure retaining structure. The closure retaining structure can be, for example, threads 104 as shown in the illustrated embodiment, or other closure retaining structures known in the art. The neck 102 terminates at the container opening, 106. Opposite to the neck 102 is a substantially circular base portion 108, which maintains the container 100 in a upright position.

The base portion 108 has rounded bottom edges 110 that transition to generally flattened longitudinal base panels 111, separated by longitudinal base edges 112. In moving upwards along the longitudinal axis of the container $L_C$ from the bottom of the base 108, the circumferential dimension of the container 100 first increases and the slope of the container walls is positive. That is, this base portion of the container is convex when viewed from the outside of the container. The container 100 then begins to narrow in circumference, at the same time changing in shape to resemble a square as one approaches the waist 114. Along this portion of the container 100 where the circumference is decreasing, the slope of the container wall is positive. Also along this portion, the container 100 is concave when viewed from the outside of the container.

There is a widest point 300 along the base portion 108 of the container 100 where the circumference of the base the greatest. (See FIGS. 3A and 3B.) From the bottom of the base until this widest point of the base 300, the slope of the container 100 is positive, the circumference of the container is increasing, and the container 100 is convex when viewed from the outside of the container. Moving from the widest point of the base 300 to the container waist 114, the slope of the container 100 is negative, the container circumference is decreasing, and the container wall is concave when viewed from the outside of the container.

Figure 3A:
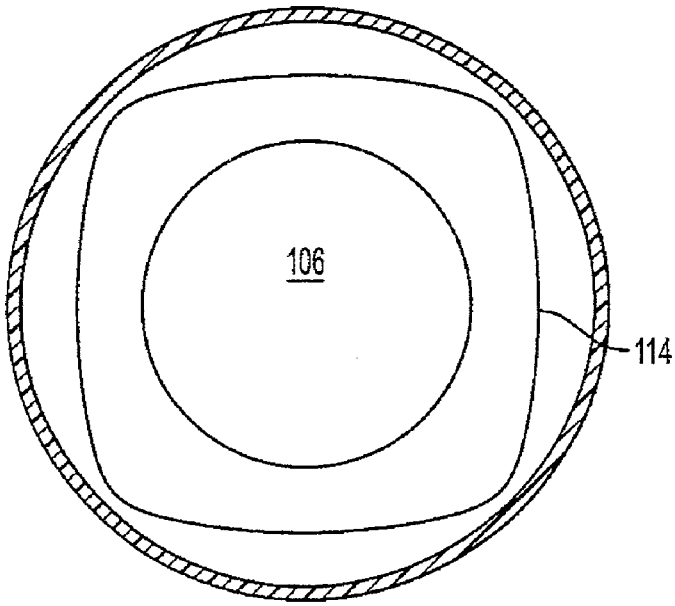
FIG. 3A depicts a cutaway view of the container of FIG. 1 along line 3A-3A, looking up according to the present invention.
Figure 3B:
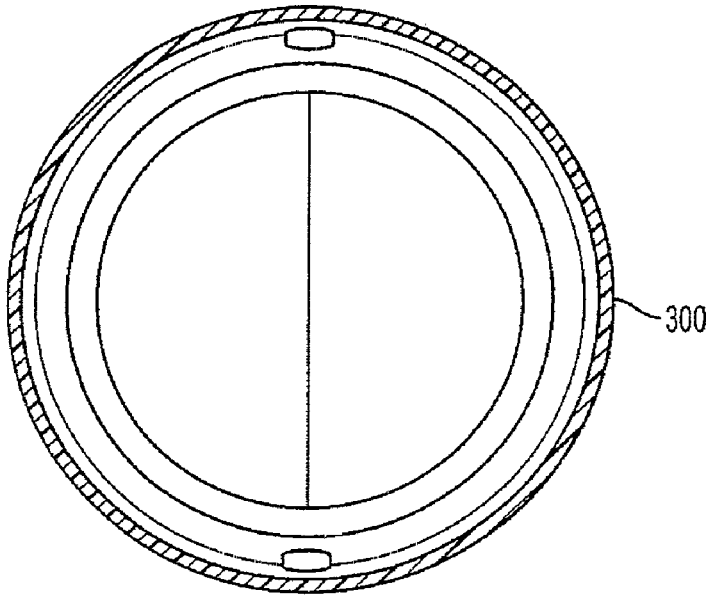
FIG. 3B depicts a cutaway view of the container of FIG. 1 along line 3B-3B, looking down according to the present invention.

FIGS. 3A and 3B are cutaway views of the container taken along the widest point of the base 300, along lines 3A-3A and 3B-3B respectively. As shown in FIGS. 3A and 3B, the container 100, at this widest base point 300, is substantially round in cross section. As one moves upwards from the widest base point 300 along the container's longitudinal axis $L_C$, the circumference of the container 100 begins to decrease and the cross section transitions from a rounded shape at the base, to a more square shape at the container waist 114. Along this portion, the slope of the container wall is negative and the shape of the container 100 along this portion is convex when viewed from the outside of the container.

Figure 5A:
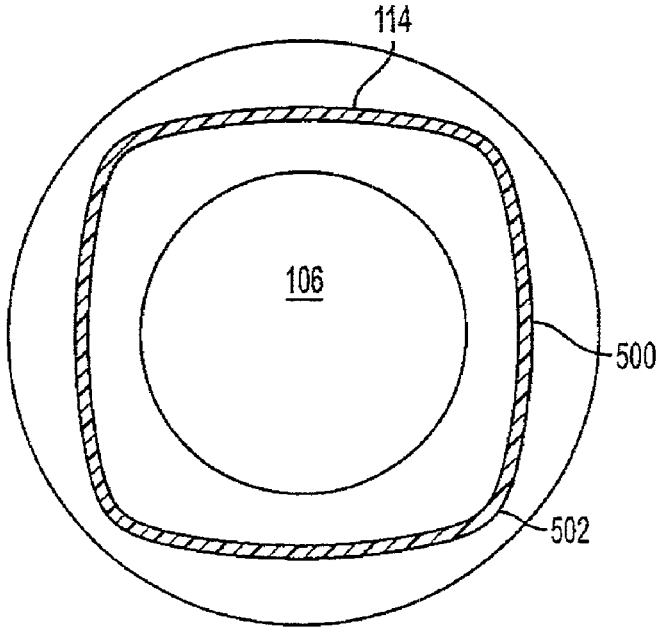
FIG. 5A depicts a cutaway view of the container of FIG. 1 along line 5A-5A, looking up according to the present invention.
Figure 5B:
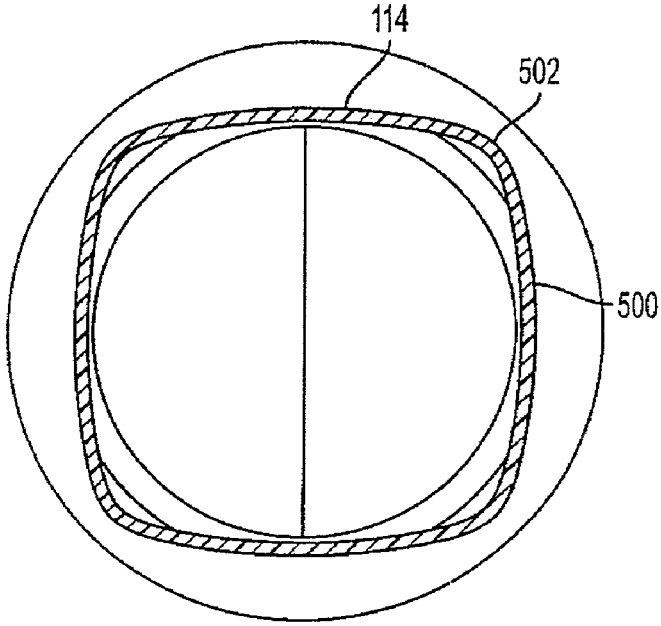
FIG. 5B depicts a cutaway view of the container of FIG. 1 along line 5B-5B, looking down according to the present invention.

The square-like shape of the waist 114 is shown in the cutaway views of FIGS. 5A and 5B. As is apparent from these figures, the sides of the square 500 can be somewhat rounded, and adjacent sides meet in chambered, rounded corners 502. Thus, in moving along the container 100 from the base 108 to the waist 114, there is a change in the circumferential dimension from the widest point of the base 300 to a most narrow portion at the waist 114.

Figure 4A:
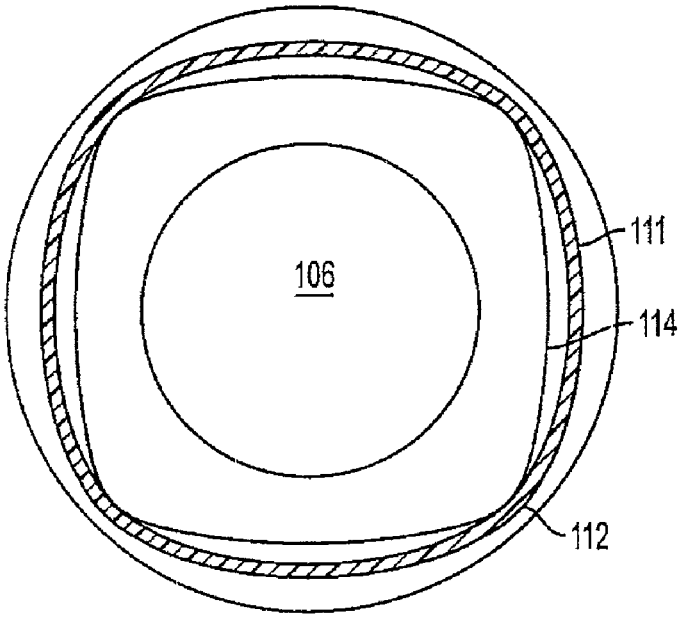
FIG. 4A depicts a cutaway view of the container of FIG. 1 along line 4A-4A, looking up according to the present invention.
Figure 4B:
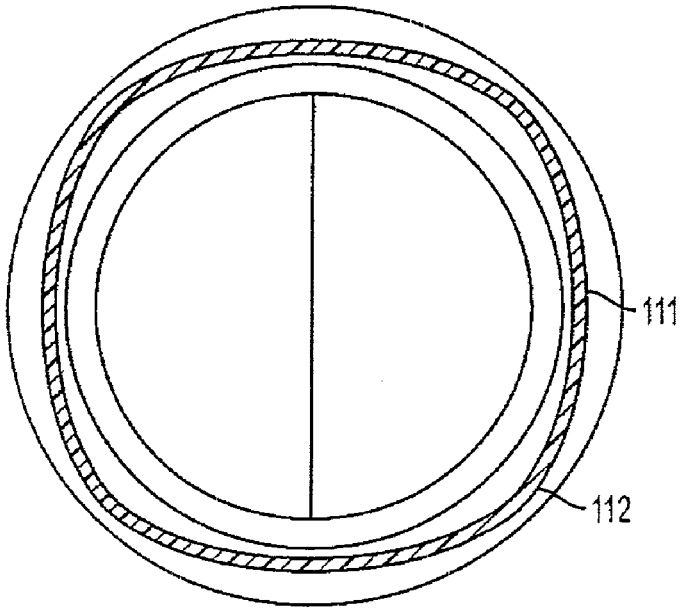
FIG. 4B depicts a cutaway view of the container of FIG. 1 along line 4B-4B, looking down according to the present invention.

An intermediate region between the widest base point 300 and the narrow waist 114 is illustrated in FIGS. 4A and 4B, taken along lines 4A-4A and 4B-4B of FIG. 1 respectively. The circumferential dimension illustrated in FIGS. 4A and 4B is an intermediate of the base 108 and waist 114—an intermediate of a circle and a square. The generally flattened longitudinal base panels 111 develop as the circular base 108 transitions to a more square shape. The longitudinal base edges 112 develop as a portion of the circular base transitions into the corners 502 of the square shaped waist 114. In transitioning from base 108 to waist 114, the generally flattened longitudinal base panels 111 widen at the expense of the longitudinal base edges 112, which narrow and tighten into corners 502. (See FIGS. 5A and 5B).

Figure 2:
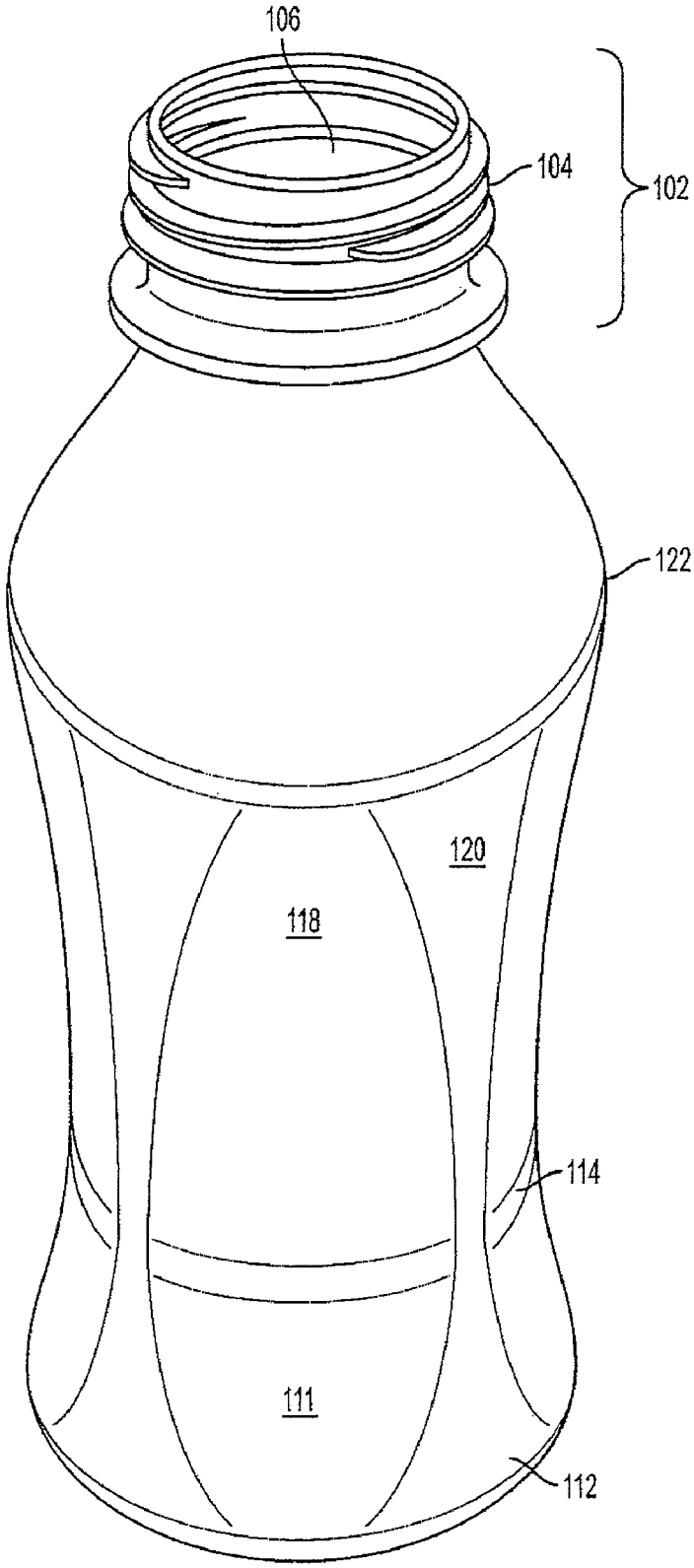
FIG. 2 depicts a perspective view of the container according to the present invention.
Figure 6A:
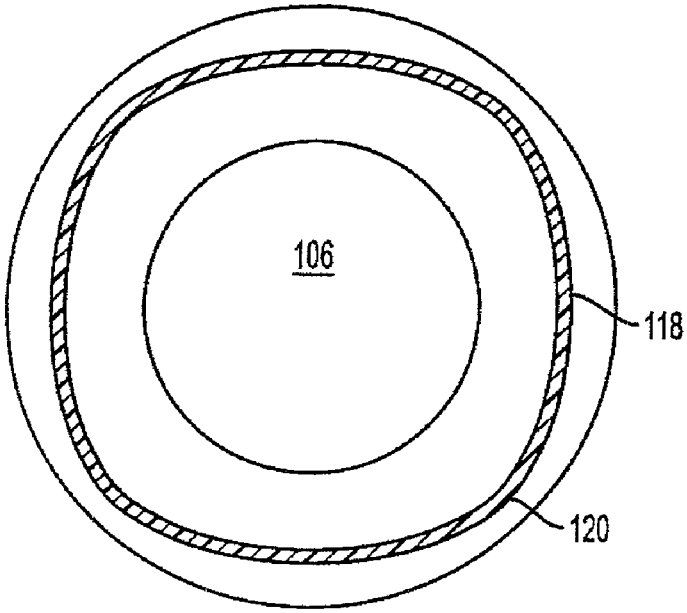
FIG. 6A depicts a cutaway view of the container of FIG. 1 along line 6A-6A, looking up according to the present invention.

The waist 114 separates the base portion 110 from the body portion 116. The waist has a circumferential dimension that is less than the circumferential dimension of the base at its widest point. The body portion 116 has flexible, substantially flat longitudinal body panels 118 separated by longitudinal body panel edges 120 (See FIGS. 1 and 2). In an exemplary embodiment such as that illustrated in FIG. 6A, the container 100 can have four longitudinal body panels 118 separated by four longitudinal body panel edges 120. FIG. 2 shows three of the longitudinal body panels 118 separated by two longitudinal body panel edges 120. The longitudinal body panels 118 are able to flex inwardly when the container 100 is filled and sealed, preventing deformation of the container 100. The low waist 114 of the container 100 substantially limits flexure to the longitudinal body panels 118, while minimizing flexure of the longitudinal base panels 111. Thus, the container 100 maintains an upright position even as controlled deformation occurs.

Moving upwards from the waist 114 along the longitudinal axis of the container $L_C$, the body portion 116 merges with the rounded circular shoulder portion 122, the circumferential dimension of the container 100 increases and the body shape transitions from the generally square waist to the substantially circular shoulder. As the body portion 116 merges with the shoulder portion 122, the longitudinal body panels 118 decrease in width/narrow, and the longitudinal body panel edges 120 increase in width. Thus, the corners 502 of the square-shaped waist 114, loosen and become more circular as the body panel edges increase in width. This increase in width of the longitudinal body panel edges 120 is apparent in FIG. 2. In order to provide structural support and further isolate flexure to the body panels 118, the longitudinal body panel edges 120 can contain more plastic material than the flexible body panels 118.

Figure 6B:
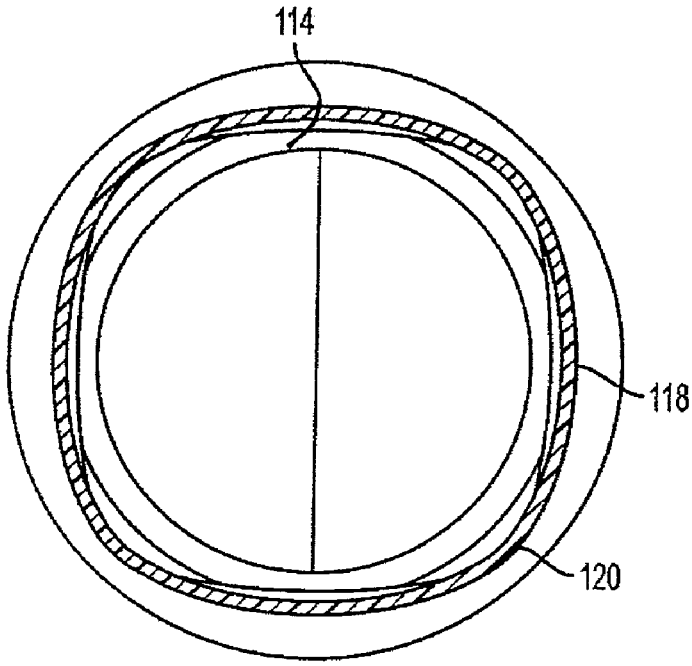
FIG. 6B depicts a cutaway view of the container of FIG. 1 along line 6B-6B, looking down according to the present invention.

In an intermediate portion of the body 116, the container is widening and changing in shape. Thus, in the cutaway views of FIGS. 6A and 6B, the circumferential dimension is an intermediate of the shoulder 122 and waist 114. The shape is also an intermediate of a circle and a square. The longitudinal body panels 118 are narrowed, while the longitudinal body panels edges 120 are increased in width and are more rounded relative to the shape at the waist 114.

The container's circular shoulder 122 finally merges with the neck 102 of the container. As the circular shoulder 122 transitions to the neck 102, the circumferential dimension of the container continually decreases. Thus the portion of the container 100 between the circular shoulder 122 and the neck 102 is defined by a sloping portion of reducing diameter. In embodiments contemplated by the present invention, the circumference of the circular shoulder is no greater than the circumference of the widest portion of the base.

The longitudinal length of the body of the container $L_A$ is longer than the longitudinal length of the base $L_B$. For example, the ratio of the longitudinal length of the body $L_A$ to the longitudinal length of the base $L_B$ can be between about 1.5:1 and 3:1. In the illustrated embodiment pictured in FIG. 1, the longitudinal length of the body $L_A$ is about two times length of the base $L_B$. In other embodiments, the ratio is about 2.3:1.

The container 100 of the present invention is suitable for use in applications requiring hot-fill processing. The container 100 is also able to accommodate an internal vacuum when the container 100 is sealed. The container 100 shrinks in an approximately uniform manner, maintaining its overall shape. The low waist 114 is designed to isolate a substantial amount of flexure, or collapse, to the longitudinal body panels 118. The increased length of the body panels 118 minimizes any overall, non-uniform collapse, preserving the integrity of the container 110. The longitudinal body panel edges 120 further isolate the flexure to the longitudinal body panels 118. Additionally, by isolating the majority of flexure and collapse to the upper portion of the container, the base 108 undergoes very little distortion or movement, and is able to maintain the container 100 in an upright position.

The container 100 can be blow molded from a thermoplastic material. The container can be made of a polyolefin such as polyethylene, for example low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. Containers according to the invention are suitable for holding fruit drinks, dairy-based drinks, shakes, energy/sports drinks, diet and health drinks, and the like. Of course the invention is not limited to these drinks alone, as the container 100 is suited for any liquid drink, as well as gels, viscous liquids and pourable solids such as powders or beads.

In another aspect the present invention is directed to a method of blow molding the container 100 described above. The method of blow molding can be injection, stretch, or extrusion blow molding. In an exemplary embodiment, the container is prepared by extrusion blow molding.

Figure 7:
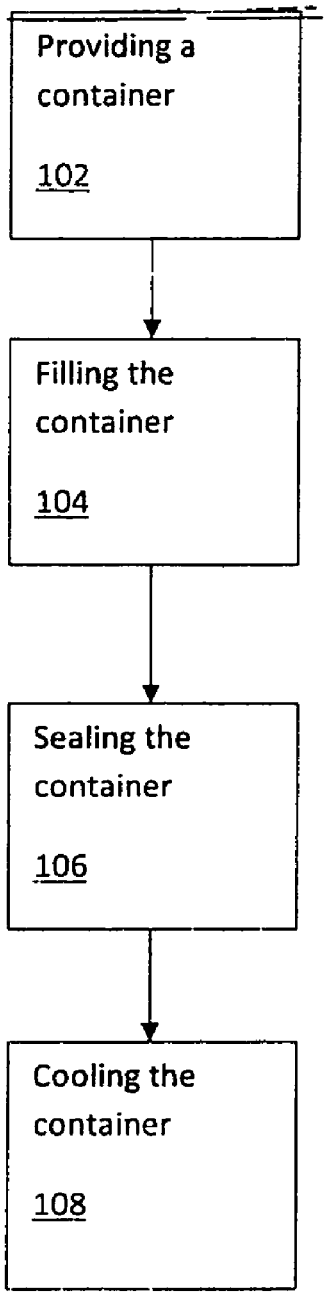
FIG. 7 is a flow chart depicting a method of hot-filling a container.

The container 100 can be filled and processed using a hot-fill production process, as shown in FIG. 7. In step 102 the container 100 is provided. Processing can encompass filling the container 100, in step 104, with a substance of elevated temperature, sealing the container, in step 106, with a closure component, and allowing the filled and sealed container to cool, in step 108. An elevated temperature is any temperature above room temperature, and particularly a temperature near the boiling point of the substance. The container 100 can be cooled to, for example, room temperature. As the container 100 and substance cools, the contained substance and any associated air pockets that may be, for example, within the head space of the container, contract, creating a partial internal vacuum. The present invention accommodates the internal vacuum in a container by having body panels 118 that are adapted to flex inwardly in response to the internal vacuum. The waist 114 of the container 100 manufactured by this method isolates flexure to the body panels 118 and minimizes or eliminates flexure along flattened longitudinal base panels 111. Thus, the container 100 is able to resist overall deformation and remain upright.

The present invention improves upon the prior art because it can withstand a hot-fill process while maintaining its shape. The container does not lose its shape because it is designed to accommodate the internal vacuum that results after the container is filled with a hot substance through interaction between the longitudinal body panels 118 and the low waist 114. The body panels 118 are long enough so that collapse of the container 100 (due to the internal vacuum generated from the hot-fill process) is minimized. Further, the low waist 114 isolates any inward flexure to the body panels 118; the base 108 does not collapse. Thus, the base 108 maintains its stability.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A plastic container having a longitudinal axis therethrough comprising:

a neck portion having a longitudinal height and terminating at an opening;

a substantially circular enclosed base opposite said neck portion adapted for maintaining said container in an upright position, wherein said base has a rounded, positive slope portion of an increasing circumferential dimension transitioning into a decreasing circumferential dimension portion having a negative slope along said longitudinal axis and further transitioning from a circular rounded portion at said base to generally flattened, longitudinal base panels with rounded, longitudinal base panel edges separating each of said base panels from each other;

a waist having a circumferential dimension less than said base and positioned between a body portion and said base;

the body portion positioned between said waist and a circular shoulder portion and comprising flexible, substantially flat longitudinal body panels and rounded, longitudinal body panel edges separating adjacent body panels from each other and merging with said longitudinal panel edges of said base, said body panel edges increasing in width as said body portion longitudinally extends from the waist and merges with the circular shoulder portion;

the circular shoulder portion having a rounded portion transitioning into and merging with said body panels, and a sloping portion of reducing diameter merging with said neck portion; and wherein a longitudinal length of said body portion is greater than a longitudinal length of said base.

2. The plastic container of claim 1, wherein the container accommodates a hot-fill production process.

3. The plastic container of claim 1, wherein the container accommodates an internal vacuum when sealed with a closure component.

4. The plastic container of claim 1, wherein the container is blow molded.

5. The plastic container of claim 1, wherein the container holds a substance selected from the group consisting of fruit drinks, dairy-based drinks, shakes and nutritional drinks.

6. The plastic container of claim 1, wherein the container is made of a polyolefin.

7. The plastic container of claim 1, wherein the circumferential dimension of said circular shoulder portion at its widest point is no greater than the greatest circumferential dimension of said base.

8. The plastic container of claim 1, wherein a ratio of the longitudinal length of the body portion to the longitudinal length of the base can be between about 1.5:1 to 3:1.

9. The plastic container of claim 1, wherein said body portion has four flexible, substantially flat, longitudinal body panels and four rounded, longitudinal body panel edges.

10. A blow molded container comprising:

a neck portion having a longitudinal height and terminating at an opening;

a substantially circular enclosed base opposite said neck portion adapted for maintaining said container in an upright position, wherein said base has a rounded, positive slope portion of an increasing circumferential dimension transitioning into a decreasing circumferential dimension portion having a negative slope along said longitudinal axis and further transitioning from a circular rounded portion at said base to generally flattened, longitudinal base panels with rounded, longitudinal panel edges separating each of said flattened base panels from each other;

a waist having a circumferential dimension less than said base and positioned between a body portion and said base;

the body portion positioned between said waist and a circular shoulder portion and comprising flexible, substantially flat longitudinal body panels and rounded, longitudinal body panel edges separating adjacent body panels from each other and merging with said longitudinal panel edges of said base, said body panel edges increasing in width as said body portion longitudinally extends from the waist and merges with the circular shoulder portion;

the circular shoulder portion having a rounded portion transitioning into and merging with said body panels, and a sloping portion of reducing diameter merging with said neck portion; and wherein the longitudinal body panels flex inwardly in response to an internal vacuum.

11. A method of hot-filling a plastic container comprising:

providing a container having a longitudinal axis therethrough comprising:

a neck portion having a longitudinal height and terminating at an opening;

a substantially circular enclosed base opposite said neck portion adapted for maintaining said container in an upright position, wherein said base has a rounded, positive slope portion of an increasing circumferential dimension transitioning into a decreasing circumferential dimension portion having a negative slope along said longitudinal axis and further transitioning from a circular rounded portion at said base to generally flattened, longitudinal base panels with rounded, longitudinal base panel edges separating each of said flattened base panels from each other;

a waist having a circumferential dimension less than said base and positioned between a body portion and said base;

the body portion positioned between said waist and a circular shoulder portion and comprising flexible, substantially flat longitudinal body panels and rounded, longitudinal body panel edges separating adjacent body panels from each other and merging with said longitudinal panel edges of said base, said body panel edges increasing in width as said body portion longitudinally extends from the waist and merges with the circular shoulder portion;

the circular shoulder portion having a rounded portion transitioning into and merging with said body panels, and a sloping portion of reducing diameter merging with said neck portion;

filling the container with a substance, said substance having an elevated temperature;

sealing the container with a closure component; and allowing the container to cool, wherein an original shape of the container is substantially maintained after allowing the filled container to cool.

12. The method of claim 11, wherein the substance is selected from the group consisting of fruit drinks, dairy-based drinks, shakes, and nutritional drinks.

13. The method of claim 11, wherein the container is made of a polyolefin.

14. The method of claim 11, wherein a longitudinal length of said body portion is greater than a longitudinal length of said base.

15. The method of claim 11, wherein a ratio of a longitudinal length of the body portion to a longitudinal length of the base can be between about 1.5:1 to 3:1.

* * * * *